US005435780A

United States Patent [19]

Ayles

[11] Patent Number: 5,435,780

[45] Date of Patent: Jul. 25, 1995

[54] VENTILATED SKYLIGHT

[76] Inventor: Paul N. Ayles, Unit 7, 51 Buckingham Drive, Wangara, Western Australia 6065, Australia

[21] Appl. No.: 216,951

[22] Filed: Mar. 24, 1994

[30] Foreign Application Priority Data

Mar. 24, 1993 [AU] Australia ..... PL7974

[51] Int. Cl.[6] ..... E04D 13/03

[52] U.S. Cl. ..... 454/199; 454/366; 454/368

[58] Field of Search ..... 454/35, 199, 366, 367, 454/368

[56] References Cited

U.S. PATENT DOCUMENTS

| | | | |
|---|---|---|---|
| 222,939 | 12/1879 | Pardessus | 454/35 |
| 226,625 | 4/1880 | Pardessus | 454/199 |
| 230,952 | 8/1880 | Mark | 454/199 |
| 2,494,679 | 1/1950 | Ward, Jr. | 454/367 X |
| 2,885,948 | 5/1959 | Oshins | 454/199 |
| 4,397,225 | 8/1983 | Patton | 454/368 |

FOREIGN PATENT DOCUMENTS

| | | | |
|---|---|---|---|
| 14512/62 | 8/1963 | Australia . | |
| 51105/73 | 7/1974 | Australia . | |
| 57986/86 | 12/1986 | Australia . | |
| 58317/86 | 12/1986 | Australia . | |
| 2812058 | 9/1979 | Germany | 454/199 |

*Primary Examiner*—Harold Joyce
*Attorney, Agent, or Firm*—Larson and Taylor

[57] ABSTRACT

A skylight (10) having a roof portion (12) with a plurality of ventilating tabs (61) and a plurality of non-ventilating tabs (62) disposed substantially parallel to and spaced above a roof (31) of a building. The ratio of ventilating tabs (61) to non-ventilating tabs (62) can be altered to alter the flow of air through the skylight. The disposition of the ventilating tabs (61) assists the draw of air through the skylight (10) and inhibits ingress of debris and water.

3 Claims, 4 Drawing Sheets

VENTILATED SKYLIGHT

FIELD OF THE INVENTION

The present invention relates to a ventilated skylight particularly, although not exclusively, envisaged for installation between a roof and a ceiling in a building.

In the art of ventilated skylights it is known to provide ventilation means above the roof line in the side of the skylights. The ventilation means is disposed in a substantially vertical wall of the skylights. Splash covers are then required on the outside of the ventilation means so as to inhibit the ingress of the rain and debris and the like into the skylight through the ventilation means. A disadvantage of such an arrangement is that the flow of air into the ventilation means is thereby restricted. Also, the prevailing winds tend to cause eddy currents of air inside and around the upper end (called the roof portion) of the skylight and hence inhibit the ventilating capacity of the skylight. Further, prior art ventilated skylights do not allow for variation in the amount of ventilation, for example, to accommodate changes in the strength of the prevailing winds of different seasons of the year, or to accommodate changes due to differing geographical location of the building upon which the skylights are installed. Still further, prior art non-ventilated skylights are typically mounted flush with the roof of the building, which mounting creates difficulties in conforming the skylight to the roof to maintain the roof weather-proof especially for circular dome type skylights on tiled rooves.

SUMMARY OF THE INVENTION

Therefore, it is an object of the present invention, to provide a ventilated skylight having a ventilation means which is disposed substantially parallel to the line of the roof.

In accordance with one aspect of the present invention there is provided a ventilated skylight for installation between a roof and a ceiling of a building, the ventilated skylight comprising:

- a web for installation into the roof, the web conforming to the roof so as to maintain the roof weather-proof, and the web having a hole for allowing passage of air and light through the roof;
- a light transmissible cover for allowing light to enter into the said hole in the web, and the light transmissible cover being weather-proof;
- a support means disposed about the hole in the web, the support means supporting the light transmissible cover above the roof so as to form a space between the roof and the light transmissible cover;
- a ventilation means associated with the support means, the ventilation means being located beneath the light transmissible cover and being disposed substantially parallel to and space above the line of the roof, the ventilation means allowing passage of air into and out of the skylight; and,
- a conduit disposed between the hole in the web and a hole in the ceiling for allowing passage of light and air through the skylight;
- whereby, in use, air can pass out of the skylight via the ventilation means and through the space between the light transmissible cover and the roof substantially uninhibited by prevailing winds.

Typically, the space between the light transmissible cover and the roof is at least large enough so that roofing tiles can be located between the cover and the web.

Preferably, the ventilation means is adjustable so as to vary the cross-sectional area for the free flow of air out of the skylight.

The present invention will hereinafter be described with particular reference to rooves being tiled roofs although, it is to be understood that it is of general applicability. For example, the skylight could be used in relation to metal or wooden rooves or the like.

BRIEF DESCRIPTION OF THE DRAWINGS

An exemplary embodiment of the present invention will now be described with particular reference to the accompanying drawings, in which.

DETAILED DESCRIPTION OF THE PREFERRED EMBODIMENT

Figure 1:
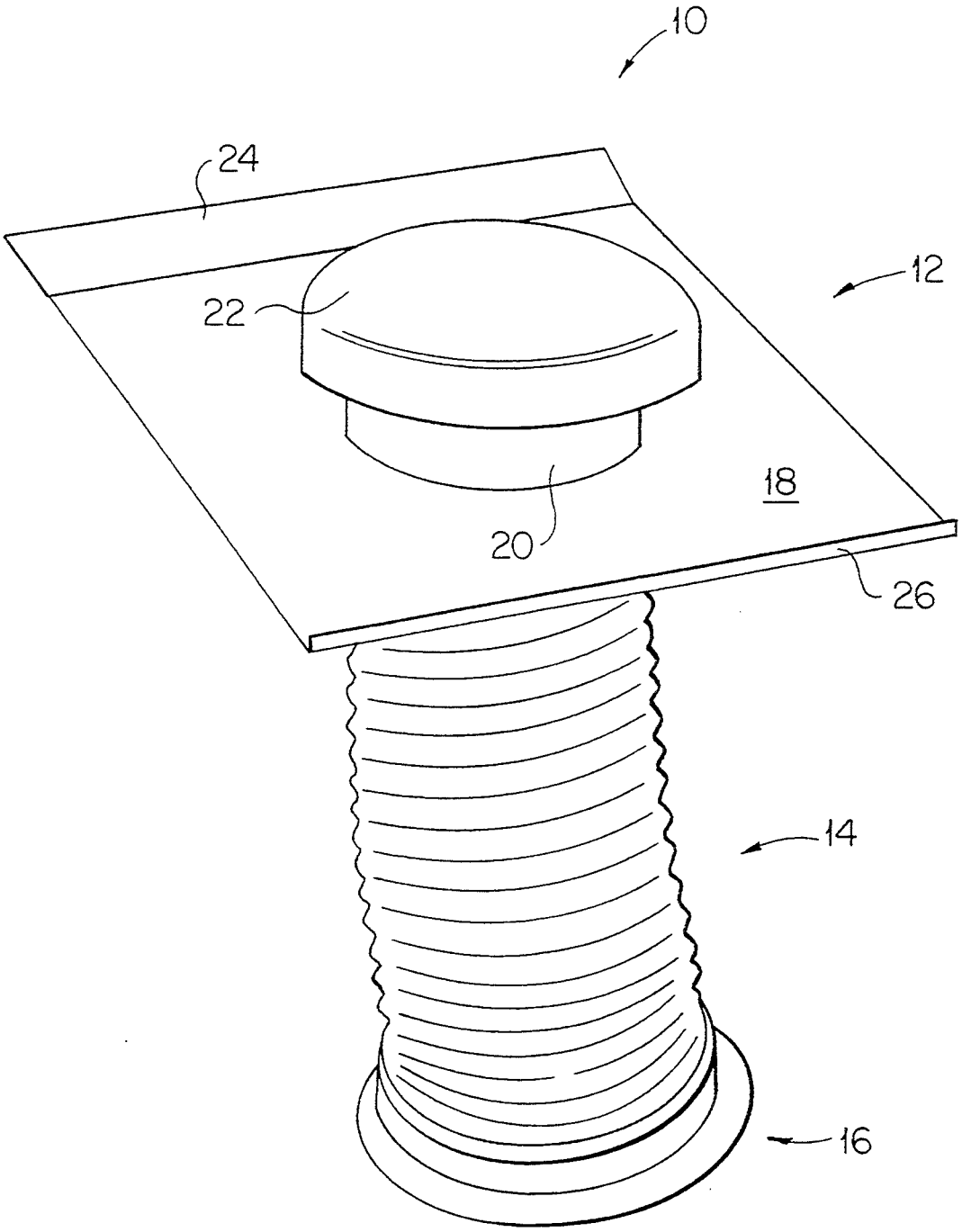
FIG. 1 is a perspective view, seen from above, of a skylight in accordance with the present invention.
Figure 2:
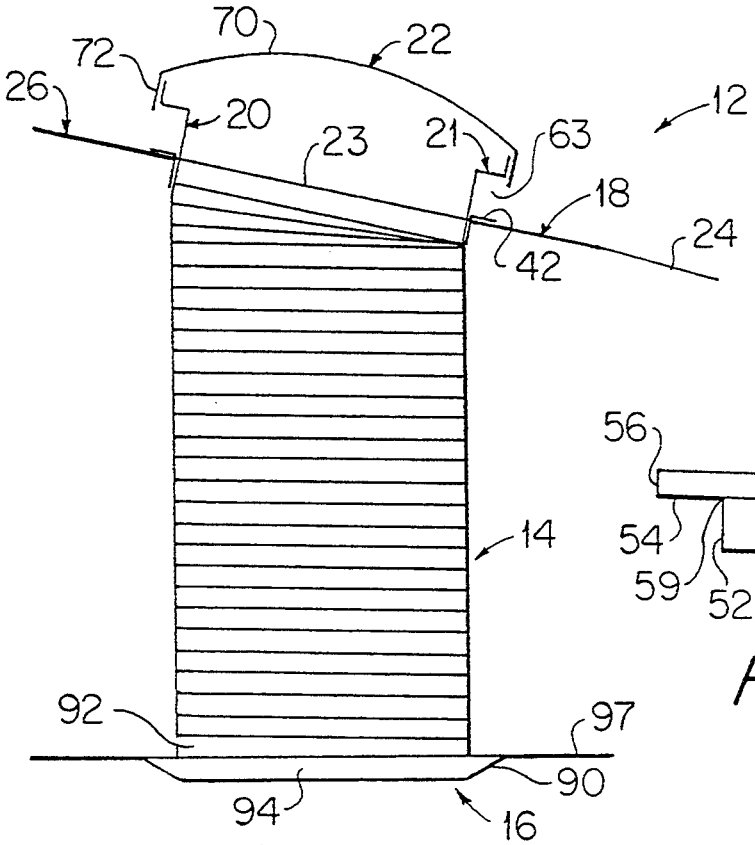
FIG. 2 is a cross-sectional side view of the skylight of FIG. 1, shown installed between the roof and the ceiling of a building.

As shown in FIGS. 1 and 2 there is a skylight 10 comprising a roof portion 12, a tube portion 14 and a diffuser portion 16.

The roof portion 12 comprises a web, known as a soaker tray 18, a support ring 20, a ventilating ring 21 and a light transmissible cover in the form of a dome 22. The soaker tray 18 is substantially rectangular in plan and has a hole 23, an edge 24 typically made from lead, at one end, and an upturned lip 26 at the opposite end. The hole 23 is dimensioned to receive the support ring 20. The lip 26 is designed to fit under the lower edge of a first roofing tile 30, of a roof 31, whilst the lead edge 24 is designed to conform to the top of a second roofing tile 32 of the roof 31. The soaker tray 18 is supported proximate the first roofing tile 30 by a first batten 34 and is supported proximate the second roofing tile 32 by a second batter 36.

Figure 3:
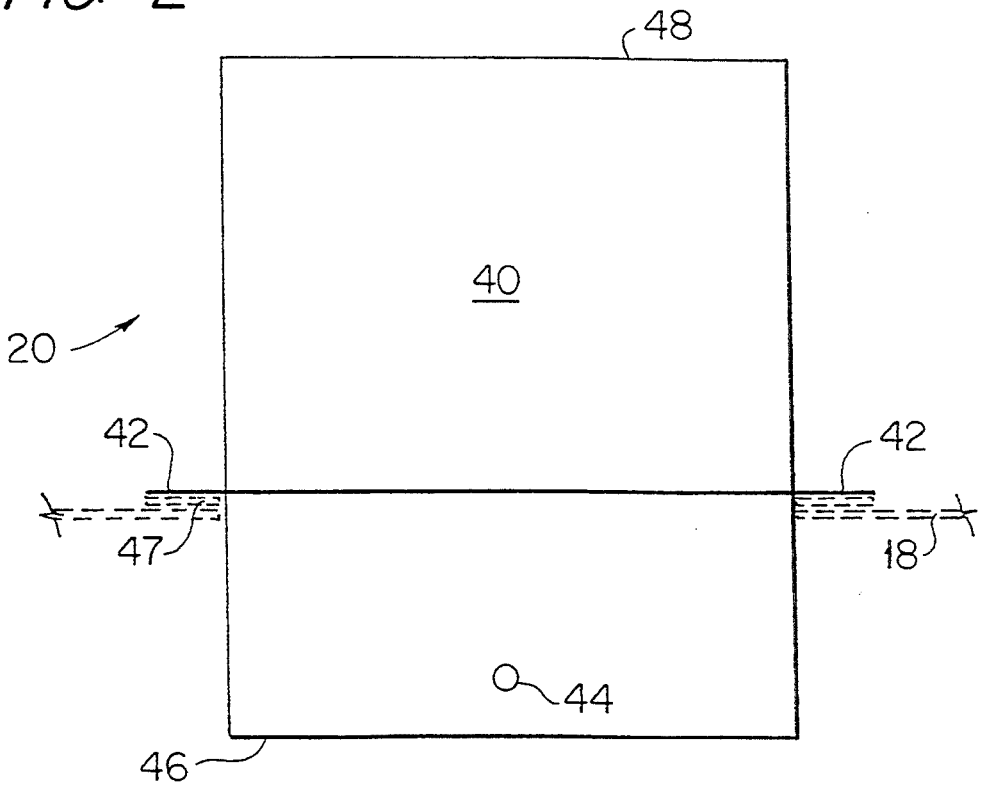
FIG. 3 is a side view of a support ring of the skylight of FIGS. 1 and 2.

Particularly as shown in FIG. 3 the support ring 20 has a cylindrical sleeve 40 with an annular flange 42 disposed radially outwardly from it intermediate the length of the sleeve 40. The sleeve 40 typically has a plurality of lugs 44 one of which is shown. The lugs 44 are located between the flange 42 and a lower edge 46 of the sleeve 40 for securement of the tube portion 14 to the sleeve 40 as described hereinafter. Typically, the support ring 20 is formed from plastics materials and is made in two halves taken parallel to the axis of the sleeve 40. The two halves are typically welded or glued together to make the sleeve 40 water-proof about its curved surface. A silicone or foam rubber seal 47 or the like is typically located between the flange 42 and the soaker tray 18 so that the junction of the support ring 20 with the soaker tray 18 is water tight.

Figure 4:
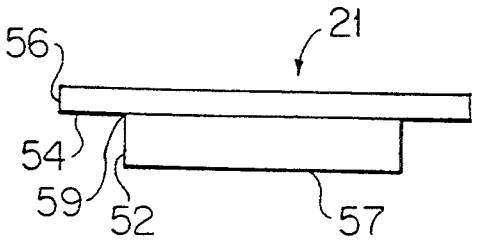
FIG. 4 is a side view of an annular ring for the support ring of FIG. 3.
Figure 5:
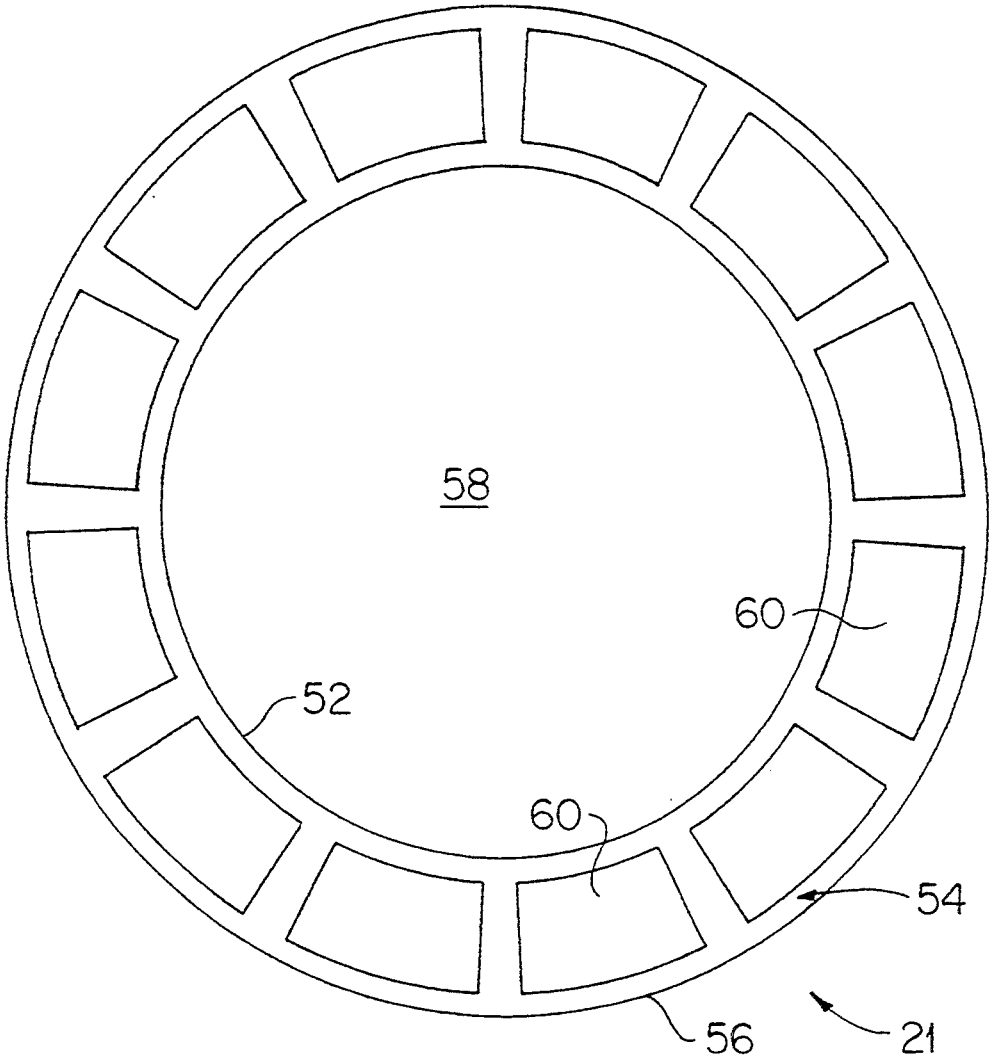
FIG. 5 is plan views of a ventilation system of the skylight of FIG. 1.
Figure 6A:
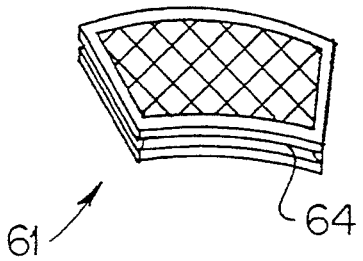
FIGS. 6A and 6B are respectively perspective views of a ventilating tab and a non-ventilating tab for the ventilation system of FIG. 5.
Figure 6B:
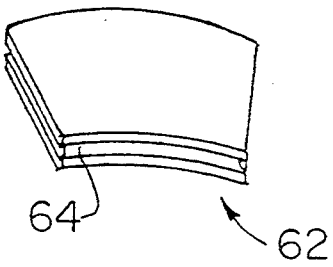

Particularly as shown in FIGS. 4 and 5 there is a ventilating ring 21 comprising a cylindrical skirt 52, a ledge 54 and a cylindrical lip 56. The cylindrical skirt 52 is designed to fit about the upper edge 48 of the sleeve 40 with a lower edge 57 of the cylindrical skirt 52 resting upon the flange 42 of the sleeve 40. Typically, the ventilating ring 21 is fixed to the sleeve 40 by gluing the cylindrical skirt 52 to the upper edge 48 of the sleeve 40. The cylindrical skirt 52 defines a hole 58 which passes through the ventilating ring 21 to allow flow of air and light through the ventilating ring 21. The ledge 54 is disposed at 90° to an upper edge 59 of the cylindrical skirt 52 and extends radially outwardly therefrom. The ledge 54 has a plurality of apertures 60 regularly spaced along it. Each aperture 60 is typically shaped as a chord segment of a toroidal hole. The apertures 60 are intended to receive ventilating tabs 61 and non-ventilating tabs 62 shown in FIGS. 6A and 6B; there being at least one ventilating tab 61.

The tabs 61 and 62 typically have a perimeteral groove 64 for securing into the apertures 60. Also, typically, the ventilating tabs 61 have a mesh or lattice structure to allow the passage of air but to inhibit the passage of water droplets, leaves, twigs and the like. By varying the number of the ventilating tabs 61 used, as compared to the non-ventilating tabs 62 the cross-sectional area of air flow through the ventilating ring 21 can be adjusted. Adjustment may be required to allow for changes in the strength of prevailing winds due to differing season and differing geographical locations.

The ledge 54 and the soaker tray 18 define a free space 63 for unrestricted flow of air about the roof portion 12 of the skylight 10.

Particularly as shown in FIG. 2 the dome 22 has a top 70 and a skirt 72 disposed downwardly from the top 70. The skirt 72 is designed to be fixed, such as by screws or the like, to the cylindrical lip 56 of the annular ring 51. Typically, the dome 22 is made from clear stabilised acrylic.

The tube portion 14 is typically a flexible tube having a highly reflective inner surface. Typically, the flexible tube is a multi-layered metallised polyester and has a spring steel reinforcement coil disposed helically along its length. Alternatively, the flexible tube could be made from reinforced aluminium foil, for example. One end of the tube portion 14 is attached onto the sleeve 40 of the support ring 20 by a circumferential strap (not shown). The strap acts with the plurality of lugs 44 to retain the tube portion 14 attached onto the sleeve 40. The other end of the tube portion 14 is attached to the diffuser portion 16. The tube portion 14 has the effect of allowing passage of sunlight down its length and of air up its length, when installed in a building.

Figure 7:
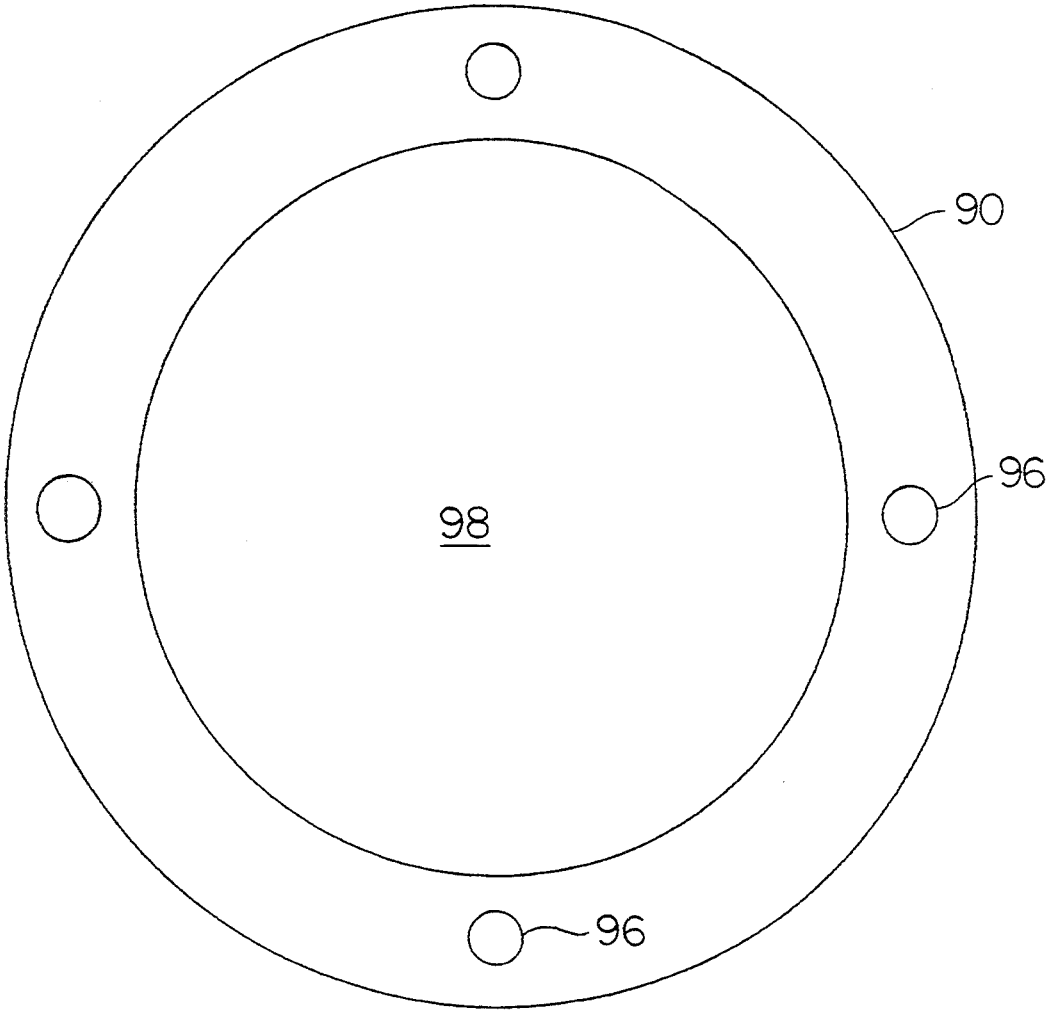
FIG. 7 is a lower plan view of a ceiling frame and diffuser of the skylight of FIG. 1; and, FIG. 8 is a side view of the ceiling frame of FIG. 6.
Figure 8:
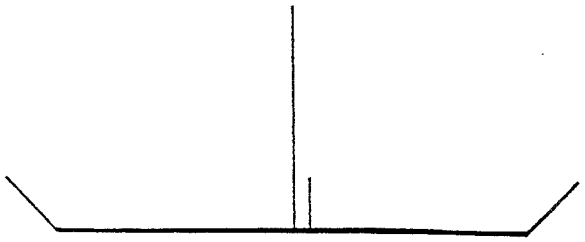

As shown in FIGS. 2, 7 and 8 the diffuser portion 16 comprises a ceiling frame 90, a ceiling ring insert 92 and a diffuser 94. The ceiling frame 90 has holes 96 for receiving fasteners such as screws or butterfly fasteners or the like for fixing the ceiling frame 90 about a hole in the ceiling 97 of the building. The ceiling frame 90 defines a hole 98 through which air and light can pass. The ceiling ring insert 92 is a cylindrical wall which is typically glued or welded to the ceiling frame 90 and is disposed upwardly therefrom fro receiving the lower end of the tube portion 14 and securing said lower end to the diffuser portion 16. The diffuser 94 is securable with the hole 88 in the ceiling frame 90 such as by conventional means. The diffuser 94 is typically made of opaque acrylic with holes in it to allow flow of air through it. Alternatively, the ceiling frame 90 could have holes to allow air to pass through the ceiling 97 and into the tube portion 14.

In use, the skylight 10 is installed between a roof 31 and ceiling 97 of a building as shown in FIG. 2. This is achieved typically by the following steps.

Firstly, the two halves of the support ring 20 are glued or welded together. The support ring 20 is then sealed onto the soaker tray 18 and fixed thereto such as with screws. The assembly is then positioned into the roof 31 as shown in FIG. 2. The tabs 61 and 62 are inserted into the holes 60 in quantities to achieve a desired amount of ventilation for the skylight 10. The dome 22 is then screwed onto the annular ring 50. The tube portion 14 is secured about the lower edge 46 of the sleeve 40 by the strap with the cooperation of the plurality of lugs 44. The lower end of the tube portion 14 is fitted into the ceiling ring insert 92. The ceiling frame 90 is screw about the hole in the ceiling 97 and the diffuser 94 is fitted into the hole 98 in the ceiling frame 90.

Light incident on the dome 22 passes through the dome 22, is reflected inside the support ring 20 and the tube portion 14, reflects down the tube portion 14 and through the ceiling 97 via the diffuser 94. Air rising up to the ceiling 97 (such as hot air) passes through the diffuser 94 (or through the ceiling frame) up the tube portion 14 and out the ventilating tabs 61. Flow of air up through the tube portion 14 is assisted by any air draft occurring through the space 63 defined between the roof 31 and the underside of the ledge 54.

Prevailing wind passing through the free space 63 tends not to enter the roof portion 12 via the ventilating tabs 61 but instead tends to create a region of lower pressure in the free space 63 which has the effect of drawing air out of the skylight 10.

Water flowing down the roof 31 is inhibited from flowing through the ventilating tabs 61 due to the spacing of the tabs 61 above the roof 31 by the support sleeve 20. Rain splashing off the roof 31 tends not to impinge on the ventilating tabs 61 and thus tends not to enter the skylight 10.

The skylight 10 has the advantage that the ventilation tabs 61 are disposed substantially parallel to the roof 31 which produces a draught effect which is not apparent in prior art vents which are disposed vertically. Also, the total area of the ventilation tabs 61 can be easily adjusted by changing the number of tabs 61 which are used so as to adjust the air flow of the skylight 10. Further, since the ventilating tabs 60 are spaced above the roof 31 the roofing tiles can by laid on top of the soaker tray 18 so as to hide the soaker tray 18 and to thus give a more aesthetic appearance. Still further, since the ventilating tabs 61 can be removed they can be readily cleaned without having to remove the skylight 10.

Modifications and variations such as would be apparent to a skilled addressee are considered within the scope fo the present invention. For example, a ventilation exhaust fan could be installed into the skylight 10. Such as in the vicinity of the diffuser portion 16. Also, the Ventilation means of the present invention could be in the form of a grille located in the ledge 54 and having two or more overlapping flat arcuate collars overlying the grille. The amount of overlap being adjustable to adjust the cross-sectional area for flow of air out of the skylight. Further, the features of the skylight 10 could be rectangular or triangular or even irregular, rather than circular.

I claim:

1. A ventilated skylight for installation between a roof and a ceiling of a building, the ventilated skylight comprising:

a web for installation into the roof, the web conforming to the roof so as to maintain the roof weather-proof, and the web having a hole for allowing passage of air and light through the roof;

a light transmissible cover for allowing light to enter into the hole in the web, and the light transmissible cover being weather-proof;

a support means disposed about the hole in the web, the support means supporting the light transmissible cover above the roof so as to form a space between the roof and the light transmissible cover;

a ventilation means comprising a plurality of apertures therein and being associated with the support means, the ventilation means being located beneath the light transmissible cover and being disposed substantially parallel to and spaced above the line of the roof, the ventilation means allowing passage of air into and out of the skylight, said ventilation means including at least one ventilating tab having a grid of relatively small apertures which allow passage of air through the at least one ventilating tab, and at least one solid, non-ventilating tab for inhibiting passage of air through the skylight, said at least one ventilating tab and said at least one non-ventilating tab being removably securable into said apertures in the ventilation means and each of said apertures in the ventilation means having one of said ventilating and non-ventilating tabs secured therein, whereby, in use, the ratio of ventilating tabs to non-ventilating tabs can be varied to vary the flow of air through the skylight; and, a conduit capable of transmitting both light and air disposed with the Upper end located at the hole in the web and the lower end located at a hole in the ceiling for allowing passage of light and air through the skylight;

whereby, in use, air can pass out of the skylight via the ventilation means and through the space between the light transmissible cover and the roof substantially uninhibited by prevailing winds.

2. A ventilated skylight according to claim 1, in which the tabs have perimeteral grooves for securement into the apertures in the support means.

3. A ventilated skylight according to claim 1, further comprising a diffuser located in the lower end of the conduit such that light and air passing through the conduit will impinge upon the diffuser, the diffuser distributing light incident upon it from the conduit and allowing passage of air through the ceiling into the conduit.

* * * * *